United States Patent [19]

Jaffe

[11] 3,992,586

[45] Nov. 16, 1976

[54] BOARDROOM SOUND REINFORCEMENT SYSTEM

[75] Inventor: Christopher Jaffe, Norwalk, Conn.

[73] Assignee: Jaffe Acoustics, Inc., Norwalk, Conn.

[22] Filed: Nov. 13, 1975

[21] Appl. No.: 631,537

[52] U.S. Cl. ..... 179/1 AT; 179/1 P

[51] Int. Cl.[2] ..... H04R 27/00

[58] Field of Search ..... 179/1 R, 1 AT, 1 HF, 179/1 P, 1 CN, 1 B

[56] References Cited

UNITED STATES PATENTS

| | | | |
|---|---|---|---|
| 1,642,040 | 9/1927 | McCutchen | 179/1 AT |
| 3,538,254 | 11/1970 | Ancha | 179/1 AT |

OTHER PUBLICATIONS

Bleazey; J., "Electronic Sound Absorbers," J. of Aud. Eng. Soc., Apr. 1962.

*Primary Examiner*—Kathleen H. Claffy
*Assistant Examiner*—E. S. Matt Kemeny
*Attorney, Agent, or Firm*—Haynes N. Johnson

[57] ABSTRACT

A sound reinforcement system for a meeting room provides improved effective communication between several individuals located at a distance from one another within a room, as around a large conference table in a corporate boardroom, by positioning a pair of speakers driven out of phase with one another at each individual location and positioning a microphone within the acoustical cancellation zone of the corresponding speaker pair. Acoustical gain is further improved by feeding the signal from each microphone to all speaker pairs except the one to which it corresponds and/or by making the level of a signal arising from a speaker pair proportional to its distance from the microphone that picked up that signal.

9 Claims, 4 Drawing Figures

BOARDROOM SOUND REINFORCEMENT SYSTEM

BACKGROUND OF THE INVENTION

This invention relates to the field of communications and more particularly to a sound reinforcement system for providing improved effective communication between individuals such as in a large meeting or corporate boardroom.

It is not uncommon for conference or meeting rooms of large corporations, law offices, government agencies and other business and service organizations to be quite large and contain tables about which may be seated from 6 to 20 or more people. Due to the size of such conference tables and the number of individuals involved, communication between individuals located at positions other than those directly adjacent or opposite one another becomes extremely difficult. For example, a rectangular conference table seating 16 people, such as may be required for the boardroom of a medium-sized corporation, may easily be of a length of 24 feet or more with the result that individuals located at extreme end positions of the table find it difficult to communicate with one another without raising their voices above normal conversational level. Not only does the distance between the individuals who wish to communicate pose a problem, but also the level of surrounding noise due to conversations carried on by other individuals may make hearing difficult. As a consequence, much communication is either lost or misunderstood or not undertaken at all. Alternatively, individuals may raise their voices to the level of shouting with the result that meetings may become disordered and individuals frustrated with their inability to effectively converse with others who are to participate in the meeting.

A straight forward solution to the foregoing problem involves amplifying the voices of the meeting participants by placing individual microphones at participant locations. While this may eliminate the need for raising voices beyond the normal conversational level, and the frustration associated therewith, it presents certain technical difficulties which prevent troublefree effective communication. Thus, with such an arrangement an amplified voice coming from a speaker located in proximity to the microphone picking up the voice signal will interfere with the unamplified voice so as to prevent effective amplification in that area and result in the difficulty known as feedback due to the amplified voice being picked up by the microphone and reamplified. In addition, the production of simultaneous sound as from several individuals speaking or laughing at once produces an unpleasant result when picked up and amplified over the system. Consequently, such a system still provides drawbacks which makes it undesirable where effective trouble free communication without annoying interferences is desired.

SUMMARY OF THE INVENTION

My invention overcomes the disadvantages of both the unamplified and simply amplified conditions described above by providing a sound reinforcement system obtaining acoustical gain so as to make effective communication within a large conference meeting or board room possible. The foregoing is accomplished according to this invention by locating each microphone for the participant position in the acoustical cancellation zone of a corresponding pair of speakers at that position. I have found that by locating the microphone symmetrically between two speakers which are driven out of phase, feed back problems are avoided and the desired acoustical improvement is achieved. To further increase acoustical gain, the signal from each microphone may be fed to all speaker pairs or groups at other participant positions except the one with which it corresponds.

Thus, it is a feature of my invention to provide a sound reinforcement system which enables effective communication between a plurality of sound generating positions or locations and a plurality of sound receiving positions or locations separated from one another by a distance but located within a single room wherein at least some of the generating and receiving locations are essentially joint, i.e. overlap, without the need for raising the voice beyond the normal conversational level and without feedback or other distracting interference.

A further feature of my invention is the provision of a sound reinforcement system in which the microphones for amplifying voices at particular positions or locations are located in the acoustical cancellation zone of a speaker group corresponding to that position.

A yet increased effectiveness of communication can be obtained through further improvement in the acoustical gain, according to my invention, by making the level of a signal arising from a speaker pair or group proportional to its distance from the microphone that picked up that signal. That is, a signal picked up by a microphone at one location is distributed with an increasing decibel gain to speaker pairs or groups located at increasing distances therefrom. In this way, the sound reinforcement system may be tailored to specific conditions and needs of the conference or meeting room and to the nature of communications involved. The signal from each microphone may be fed to all pairs of speakers except the one to which it corresponds for further improvement.

Therefore, it is yet a further feature of my invention to provide a sound reinforcement system enabling communication between a plurality of participants located a distance from one another in a room by amplifying their voices so that at each participant location the voice of an individual remote therefrom appears to be at normal conversational level without the presence of distracting effects of feedback or other interference due to simultaneous conversation.

According to another feature of my invention, for convenience of installation, each speaker pair and the microphone positioned symmetrically therebetween may comprise a single unit or module-like construction, a plurality of which are assembled together to form a sound reinforcement system of the particular dimensions needed for a specific application.

DETAILED DESCRIPTION OF THE DRAWINGS

Figure 1:
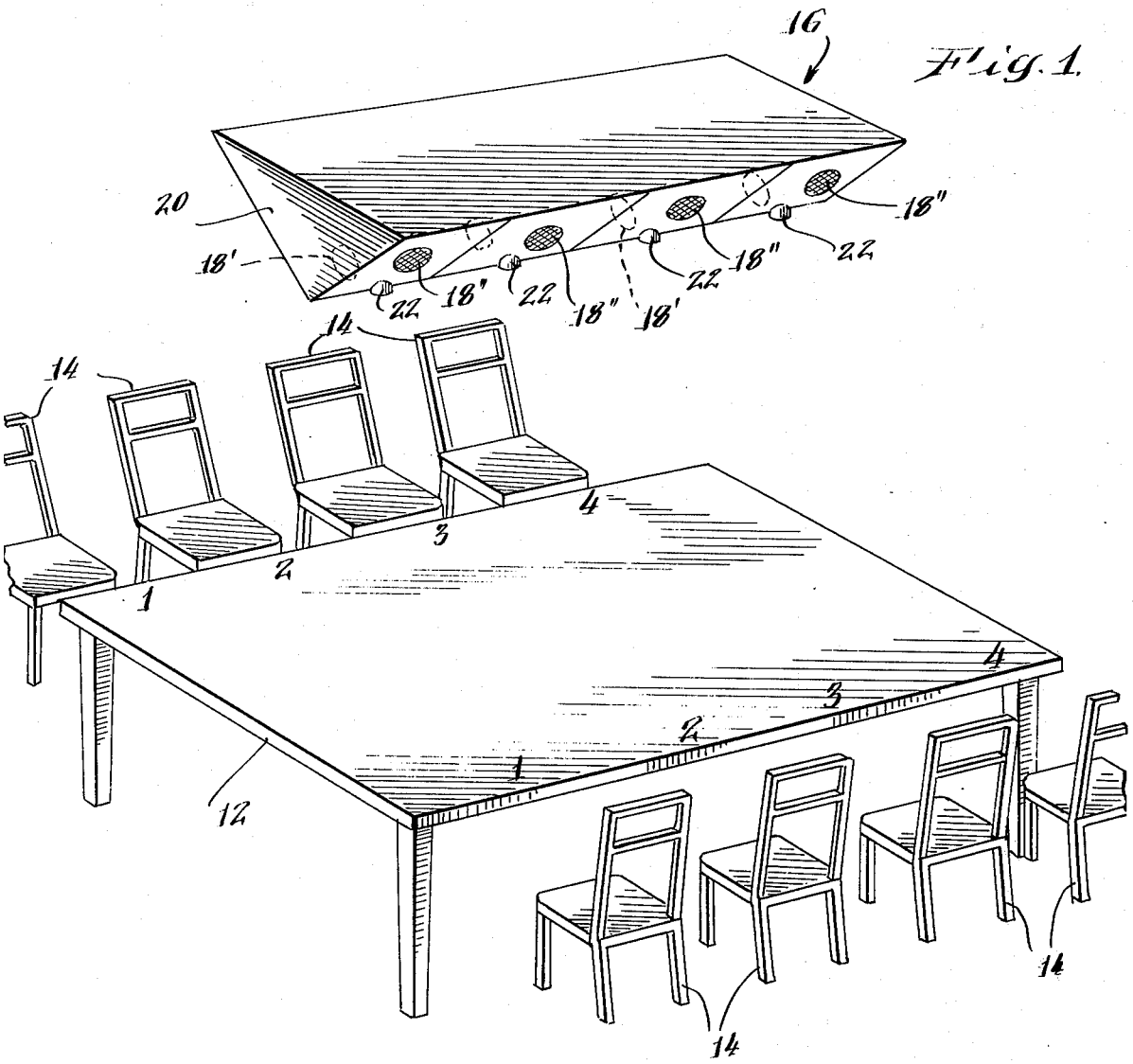
FIG. 1 is a perspective view of the interior of a conference room looking down upon a conference table with participant locations indicated by side chairs and showing, in perspective and partly in phantom, an embodiment of the sound reinforcement system according to the present invention positioned over the conference table.

FIG. 1 illustrates a representative meeting or conference room 10 containing a conference table 12 of a size suitable for seating 8 to 10 individuals. Located around the conference table 12 are side chairs 14 on which the conference participants are seated during the progress of the meeting or conference discussion. For illustrative purposes, the participant locations are numbered 1 through 4 with a single number representing two participants positioned directly opposite one another at one location. Thus there are four locations for the eight participants.

Positioned above the conference table 12 and extending the length thereof is a sound reinforcement system 16. The sound reinforcement system 16 includes four pairs of speakers 18 located at positions corresponding to the first four locations of the participants around the conference table 12. For convenience of notation, a pair of speakers will be denoted 18 while the individual speakers of each pair will be referred to as 18' and 18''. The system may project down from the ceiling as shown or may be mounted behind perforated ceiling panels so as to be unobtrusive.

Figure 2:
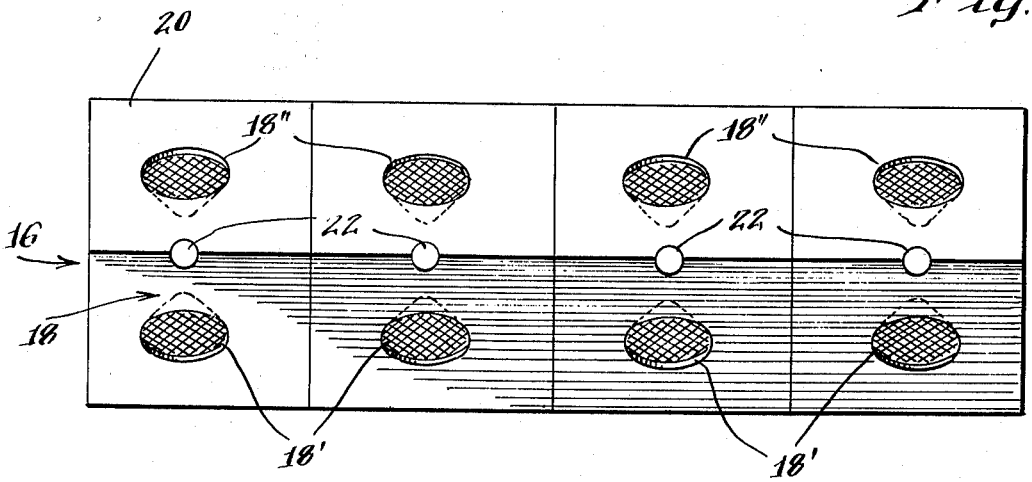
FIG. 2 is a bottom plan view of the sound reinforcement system shown in FIG. 1.
Figure 3:
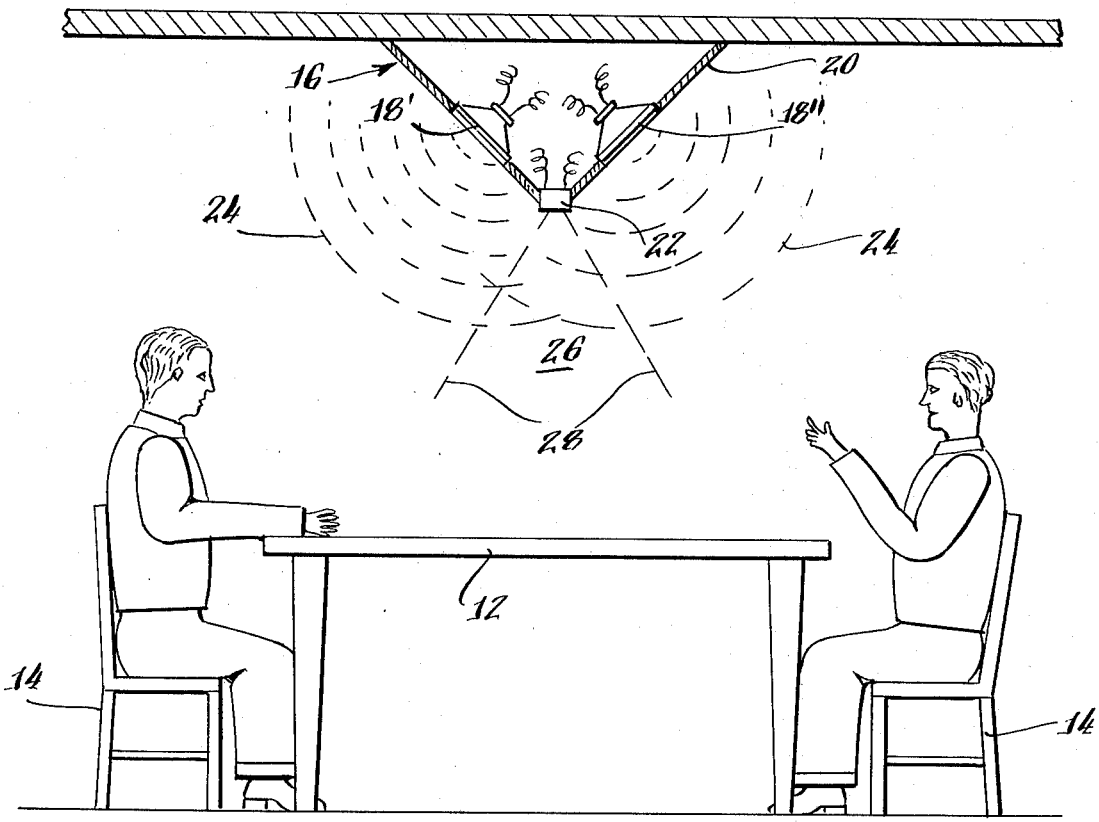
FIG. 3 is a side elevational view of the conference room and sound reinforcement system shown in FIG. 1 showing, in greater detail and cross section, the positioning of the pair of speakers and the microphone located therein and schematically illustrating the acoustical cancellation zone.

Referring to FIGS. 1–3, it can be seen that the speakers 18 are positioned within a triangularly shaped housing 20 so that each speaker of a pair is positioned at a positive angle to the horizontal table to project sound downward and direct it towards the participants gathered around the table. Since the housing 20 is centered above the conference table, as shown, each of a pair of speakers is directed only to those participants located on the same side of the conference table as is that particular speaker. Located approximately at the apex of the triangular housing 20 are microphones 22. When the speakers are mounted behind a ceiling, the microphones may be flush mounted in camouflaged panels attached to the ceiling. The microphones 22 are positioned corresponding to the location of the participants of the conference, 1 through 4, and positioned symmetrically between the two speakers 18' and 18'' of each speaker pair.

FIG. 3 illustrates the acoustical cancellation zone of the speaker group by virtue of the wave like lines 24 shown as interfering in the area 26 bounded by the lines 28. Within this area, the microphone 22 is located. It is to be understood that the representation in FIG. 3 is for illustrative purposes only.

The acoustical cancellation zone 26 is obtained by driving the two speakers 18' and 18'' out of phase. To further increase acoustical gain, a signal from each microphone 22 is fed to all speaker groups except the one with which it corresponds. In addition, the level of signal arising from a speaker pair 18 may be made proportional to its distance from the microphone that picked up the signal. For example, a signal picked up by microphone 22 at position 4 is distributed to the speaker pair at position 1 with, for example, a 6dB (decibel) gain, to the speaker pair at position 2 with a 4dB gain, to the speaker pair at position 3 with a 2dB gain, and not at all to the speaker pair at position 4. The foregoing is exemplary and the particular degree of gain can be adjusted to meet the existing conditions of the conference room such as size, background noise level and other parameters prevailing.

Figure 4:
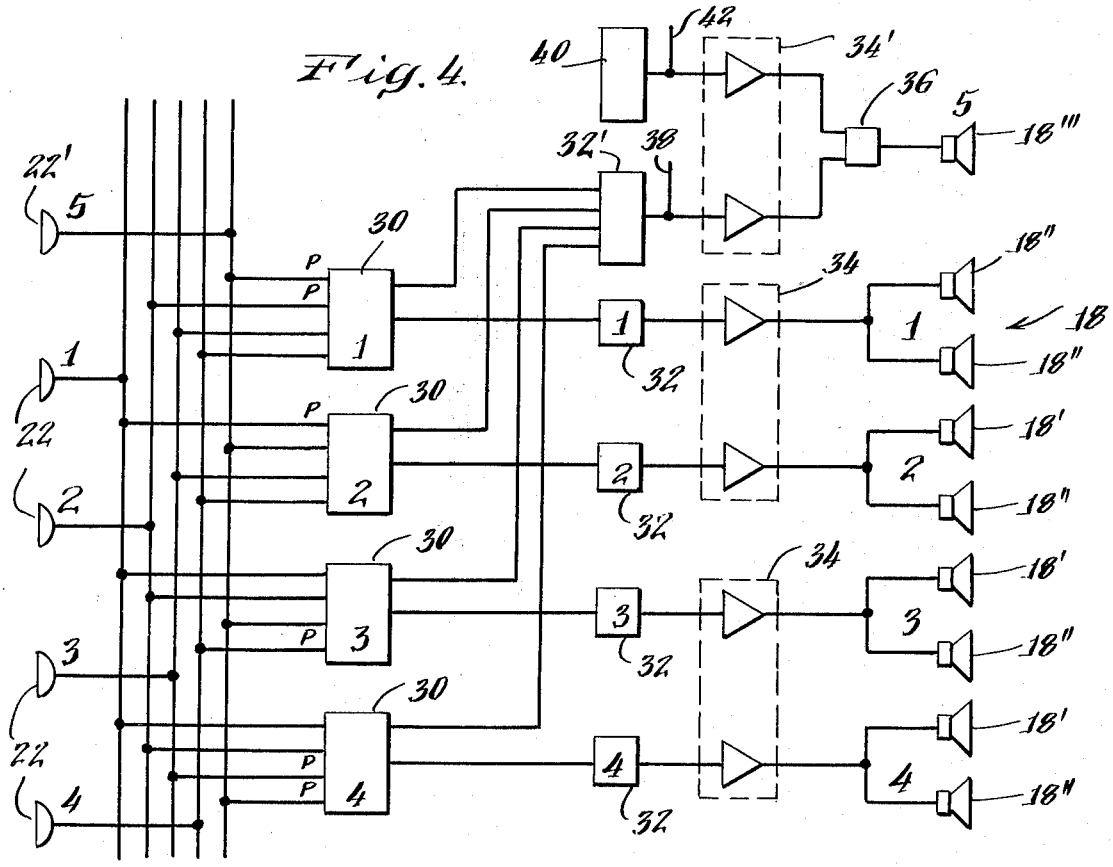
FIG. 4 is a schematic circuit diagram illustrating the wiring of the sound reinforcement system of FIG. 1 for a representative four-position conference room table.

The manner in which the signals from each microphone are distributed to the speakers 18 at the various locations with differing signal levels by using mixers is shown in the schematic circuit diagram of FIG. 4.

Referring to FIG. 4, there are shown, at the left of the circuit diagram, the microphones 22 which are located in the cancellation zone of the corresponding speaker pairs 18. The microphones and corresponding speaker pairs are numbered 1 through 4 to correspond to the conference participant locations as described above with respect to FIGS. 1 and 2. The circuit diagram illustrates the manner in which signals from each microphone 22 are distributed to the speakers at the various levels of acoustical gain by using mixers 30 in the arrangement as shown. Equalizers 32 and amplifiers 34 are also illustrated in their appropriate positions in the circuit according to this invention.

As can be seen in FIG. 4, an additional microphone 22 is shown at a position denoted by the numeral 5. This additional microphone is merely one which is located in the conference room to pick up live conversation in the entire room rather than functioning as for sound reinforcement around the conference table itself. The additional speaker shown at position 5 is one which may be situated in an adjacent room for the purposes of monitoring live conversation in the conference room itself by adjusting the monitoring selection switch 36. A monitoring amplifier 34' is also shown in this line. Conversation in the conference room and around the conference table may also be externally recorded by connecting a patch cord 38 as shown. For this purpose, the signal balance of all microphones may be preset and locked. In addition to monitoring the live conversation in the conference room, tape input or recording may be monitored by use of the monitor selector switch 36' to obtain the signal from the recorder 40. For this purpose, there is also provided a recorder mixer 32' and the line 42. To aid in further understanding of FIG. 4, phantom power lines are labeled with a P. The speakers 18'' have a reversed phase from those of 18' to provide the acoustical cancellation zone.

Although those skilled in this art will be familiar with the circuit components utilized herein, satisfactory results have been obtained with the following manufacturers' equipment. The equalizers 32 are Shure, type M-610 while the mixers are Shure, type M-67. The microphones are Knowles BT-1759 and the amplifiers are Crown, type D-60. Line transformers were Custom.

Objective measurements have verified the performance of the sound reinforcement system. For example, with a sound source located at participant location 4 and the listener moving from location 1 towards location 4, it was observed that source identification changed from the overhead speakers at or about the center of the conference table. This corresponds to expectations from the sound level measurements and the difference in signal arrival time between the original source and overhead speaker. Time delay poses no problem for a conference room of usual size. However, if distances are great between the source of sound or conference participant locations and the other speakers, a time delay can be built in as is known in the art to adjust signal arrival time with non-reinforced sound.

At a conference room ambient sound level of 38dBA, approximately 5dB of acoustical gain has been obtained between opposite ends of a 4-location table according to this invention. These results, shown in TABLE 1 below, represent a significant improvement in speech articulation.

TABLE 1

| | LISTENER LOCATION | | | | | | | |
|---|---|---|---|---|---|---|---|---|
| | 1 | | 2 | | 3 | | 4 | |
| SOURCE LOCATION | ON | OFF | ON | OFF | ON | OFF | ON | OFF |
| 3 | 65* | 62 | 66.5 | 66 | | | 66.5 | 66 |
| 4 | 64 | 59 | 63 | 62 | 66.5 | 66 | | |
| 5 | 63 | 58 | 61 | 59 | 63 | 62 | 65.5 | 65 |

*All levels dBA

Controls for the system can be provided at a conveniently located rack panel. The speech reinforcement system may be of the "hands off" type which is self operating having once been turned on and off by one switch located on the rack panel. Mixer, equalizer and amplifier controls may be preadjusted and provided with locking panels to avoid accidental misadjustment, as is known in the art. Final system balance controls will be made according to the conditions prevailing in each conference room environment and are readily obtained through routine observation.

Although the specific embodiment described herein is one directed for use in a conference or board room, it is to be understood that the sound reinforcement system according to my invention finds use in many other applications including such areas as legislative meeting halls, theaters and the like.

I claim:

1. A sound reinforcement system for obtaining acoustical gain between a plurality of sound generating locations and a plurality of sound receiving locations separated from one another by a distance wherein at least some of the sound generating and the sound receiving locations are essentially joint comprising at least a pair of speakers positioned at each joint location, the speakers of the pair being driven out of phase with each other to provide an acoustical cancellation zone therebetween, at least one microphone positioned at each joint location, the microphone being positioned in the acoustical cancellation zone of the corresponding speaker pair of that location.

2. A sound reinforcement system as claimed in claim 1 further comprising means for feeding a signal from each microphone to all pairs of speakers except the one with which it corresponds at the joint location.

3. A sound reinforcement system as claimed in claim 1 further comprising mixer means for adjusting the level of a signal from a speaker pair proportional to its distance from the microphone that picked up the signal.

4. A sound reinforcement system as claimed in claim 3 further comprising means for feeding a signal from each microphone to all pairs of speakers except the one with which it corresponds at the joint location.

5. A sound reinforcement system as claimed in claim 3 further comprising time delay means for adjusting the signal arrival time between a sound generating location and a sound receiving location to correspond to the arrival time of the non-reinforced sound giving rise to the signal.

6. A sound reinforcement system as claimed in claim 1 further comprising means for monitoring, at a location removed from the sound generating and receiving location, the signals therein.

7. A sound signal receiving and reproducing modular unit for use in a sound reinforcement system comprising a pair of speakers adjacent one another in back to back relationship, each speaker of the pair being driven out of phase with the other of the pair to provide an acoustical cancellation zone therebetween and a microphone located in the acoustical cancellation zone whereby sound signal feed-back between the speakers and microphone is eliminated.

8. A sound signal receiving and reproducing modular unit as claimed in claim 7 wherein the microphone is located symetrically between the two speakers of the pair.

9. A sound signal receiving and reproducing modular unit as claimed in claim 7 wherein the signal from the microphone is not fed to the speakers of the unit.

* * * * *